US009861132B2

(12) United States Patent
Li et al.

(10) Patent No.: US 9,861,132 B2
(45) Date of Patent: Jan. 9, 2018

(54) ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Shuyun Hu, Shenzhen (CN); Xianming Wang, Shenzhen (CN); Youlin He, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 297 days.

(21) Appl. No.: 14/574,291

(22) Filed: Dec. 17, 2014

(65) Prior Publication Data

US 2015/0181943 A1 Jul. 2, 2015

(30) Foreign Application Priority Data

Dec. 31, 2013 (CN) ..... 2013 2 0883181 U
May 23, 2014 (CN) ..... 2014 2 0266716 U

(51) Int. Cl.
*A24F 47/00* (2006.01)
*H05B 3/48* (2006.01)

(52) U.S. Cl.
CPC ..... *A24F 47/008* (2013.01); *H05B 3/48* (2013.01)

(58) Field of Classification Search
CPC ..... A61M 15/06; A24F 47/00; A24F 47/008
See application file for complete search history.

(56) References Cited

U.S. PATENT DOCUMENTS

2013/0037041 A1* 2/2013 Worm ..... A24F 47/008 131/329
2013/0192617 A1* 8/2013 Thompson ..... A24F 47/008 131/329
2013/0199528 A1* 8/2013 Goodman ..... F22B 1/282 128/203.26
2013/0319436 A1* 12/2013 Liu ..... A24F 47/008 131/329
2013/0333711 A1* 12/2013 Liu ..... A24F 47/002 131/329

* cited by examiner

*Primary Examiner* — Cynthia Szewczyk
(74) *Attorney, Agent, or Firm* — Cheng-Ju Chiang

(57) ABSTRACT

An exemplary atomizer of an electronic cigarette includes an atomizing tube and an atomizing assembly arranged in the atomizing tube. The atomizing assembly includes a ceramic tube and a heating element. The heating element is in contact with an inner surface of the ceramic tube. The ceramic tube defines a plurality of liquid absorption hole.

19 Claims, 6 Drawing Sheets

ATOMIZER AND ELECTRONIC CIGARETTE HAVING SAME

TECHNICAL FIELD

The present invention relates to electronic cigarettes, and particularly to an atomizer and an electronic cigarette using same.

BACKGROUND ART

An electronic cigarette includes an atomizer and a battery assembly. In a typical atomizer, the atomizing assembly usually includes a glass fiber core and a heating wire wound around the glass fiber core. The glass fiber core is configured for conducting tobacco liquid, while the heating wire is for heating the tobacco liquid. However, the glass fiber core may contain dust, which may cause disease of respiratory system or skin allergy of production line workers in manufacturing process.

What is needed, therefore, is an atomizer and an electronic cigarette using same, which can overcome the above shortcomings.

SUMMARY

An exemplary atomizer of an electronic cigarette includes an atomizing tube and an atomizing assembly arranged in the atomizing tube. The atomizing assembly includes a ceramic tube and a heating element. The heating element is in contact with an inner surface of the ceramic tube. The ceramic tube defines a plurality of liquid absorption hole.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail below and with references to the drawings.

Figure 1:
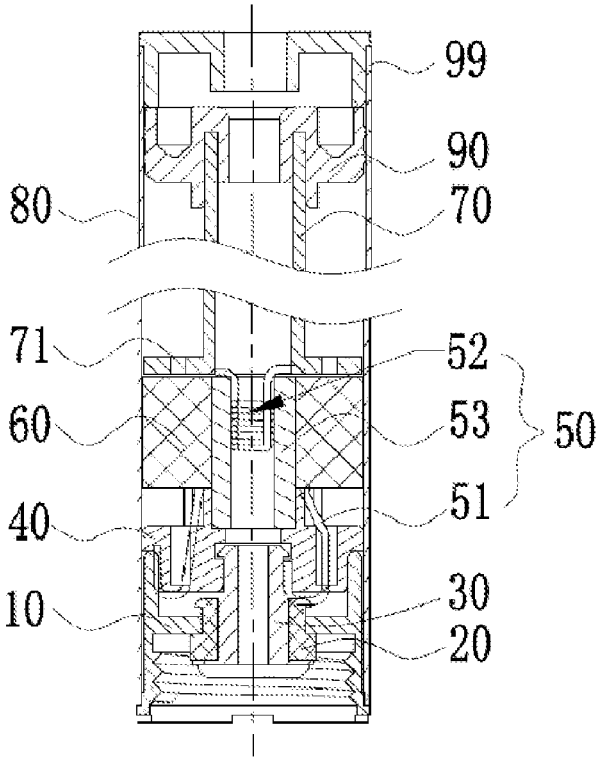
FIG. 1 is a cross-sectional view of an atomizer according to a first embodiment.
Figure 2:
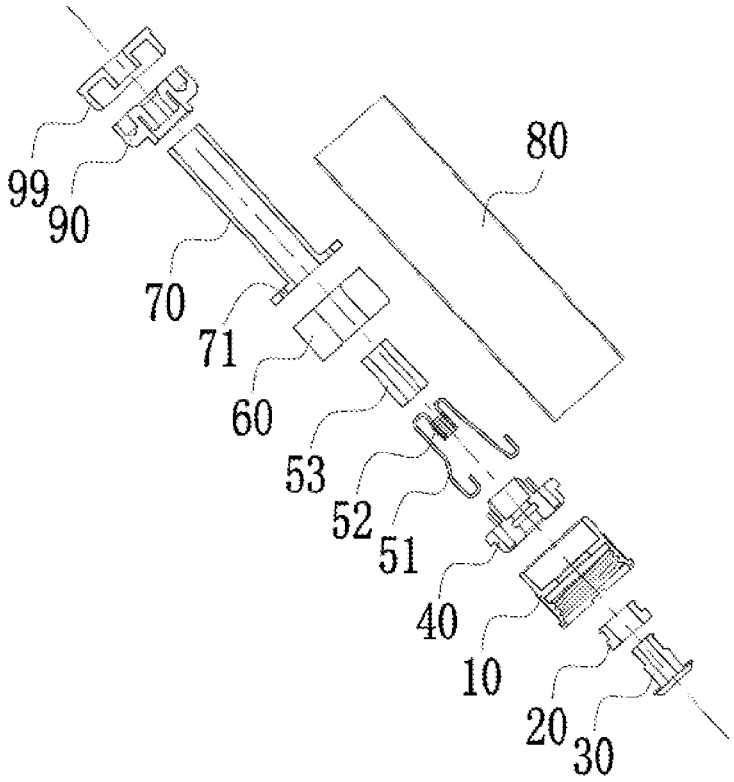
FIG. 2 is an exploded perspective view of the atomizer of FIG. 1.

Referring to FIGS. 1-2, an atomizer for an electronic cigarette includes an atomizing tube 80, and an atomizing assembly 50 in the atomizing tube 80. The atomizing assembly 50 includes a ceramic tube 53, a heating element 52, and wires 51 which are electrically connected between the heating element 52 and a power supply (details explained later). At least one part of the heating element 52 is positioned in the ceramic tube 53. The ceramic tube 53 defines a plurality of liquid absorption holes in a sidewall. A size of the liquid absorption hole may be controlled during sintering process. The heating element 52 may be a heating wire. The heating element 52 extends along a longitudinal direction of the ceramic tube 53 for a preset length, and its entire outer surface is completely in contact with an inner wall of the ceramic tube 53. The wires 51 respectively extend from the heating element 52 toward one end of the ceramic tube 53 along the inner wall of the ceramic tube 53, and then extend from the one end of the ceramic tube 53 toward the other end of the ceramic tube 53 along an outer wall of the ceramic tube 53. The atomizer further includes a fixing sleeve 10, an insulated ring 20, a tubular electrode 30, a silicone holder 40, a liquid storage element 60, an air pipe 70, a liquid outlet 71, a liquid blocking plug 90, and a mouthpiece cover 99.

One end of the atomizing tube 80 is connected to the fixing sleeve 10, and the other end of the atomizing tube 80 is connected with the mouthpiece cover 99. The tubular electrode 30 is connected with the fixing sleeve 10, and is kept insulated from the fixing sleeve 10 by the insulated ring 20. The atomizing assembly 50 is disposed in the atomizing tube 80. The ceramic tube 53 is uprightly arranged in the atomizing tube 80. The atomizing assembly 50 is engaged with the silicone holder 40. The heating wire 22 is wound to form a coil, and undergoes electric insulating treatment. One end of the heating wire 22 is connected to the tubular electrode 30 via the wire 23, and the other end of the heating wire 22 is connected to the fixing sleeve 10 via the wire 23. The liquid storage element 60 is arranged between the ceramic tube 53 and the atomizing tube 80. The air pipe 70 is arranged in one end of the atomizing tube 80, adjacent to the mouthpiece cover 99. A liquid blocking plug 90 is arranged between the air pipe 70 and the mouthpiece cover 99. The liquid outlet 71 is defined at one end of the air pipe 70. The air pipe 70 and the atomizing tube 80 cooperatively define a liquid chamber for accommodating tobacco liquid. The tobacco liquid flows to the liquid storage element 60 through the liquid outlet 71, and then penetrates into the ceramic tube 53. In use, because the ceramic tube 53 has good thermal conductivity, heat generated by the heating element 52 is conveyed to the ceramic tube 53, and then the tobacco liquid stored in the liquid storage element 60 is heated to form aerosol by the ceramic tube 53. A hollow part of the ceramic tube 53, the air pipe 70, the liquid blocking plug 90 and the mouthpiece cover 99 cooperatively form an air passage. The aerosol passes through the air passage, and then reaches a mouth of a user of the atomizer.

It is to be understood that the atomizer may be a disposable atomizer, or a refillable atomizer.

In the atomizer in accordance with the present embodiment, the ceramic tube replace traditional glass fiber core, and it is easy to assemble the atomizer. Furthermore, the atomizer is environmental friendly.

Figure 3:
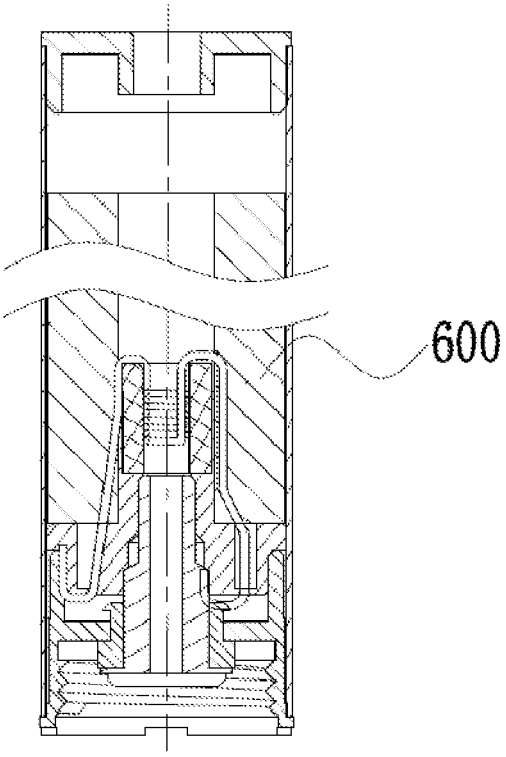
FIG. 3 is a cross-sectional view of an atomizer according to a second embodiment.

Referring to FIG. 3, the atomizer of the present embodiment differs from the atomizer of the first embodiment mainly in that no independent liquid chamber exists. The atomizer includes a liquid storage element 600 wrapping around the ceramic tube. Tobacco liquid is stored in the liquid storage element 600.

Figure 4:
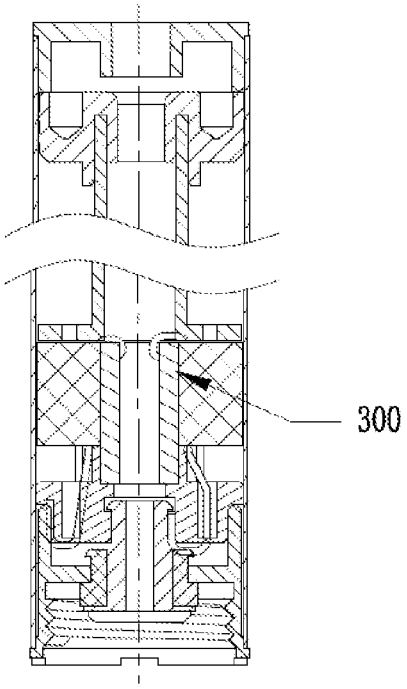
FIG. 4 is a cross-sectional view of an atomizer according to a third embodiment.

Referring to FIG. 4, the atomizer of the present embodiment mainly differs from the atomizer of the first embodiment in that the heating element 300 and the ceramic tube are integrally formed. In production, the heating wire is placed into a mold, and then ceramic slurry is injected into the mold, thus integrally forming the heating wire and the ceramic tube.

Figure 5:
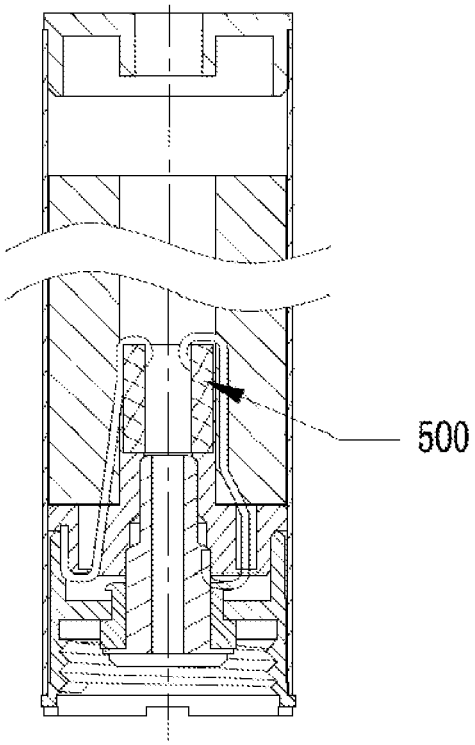
FIG. 5 is a cross-sectional view of an atomizer according to a fourth embodiment.

Referring to FIG. 5, the atomizer of the present embodiment is similar to that of the second embodiment, mainly differs in that the heating element 500 and the ceramic tube are integrally formed. In production, the heating wire is placed into a mold, and then ceramic slurry is injected into the mold, thus integrally forming the heating wire and the ceramic tube.

Figure 6:
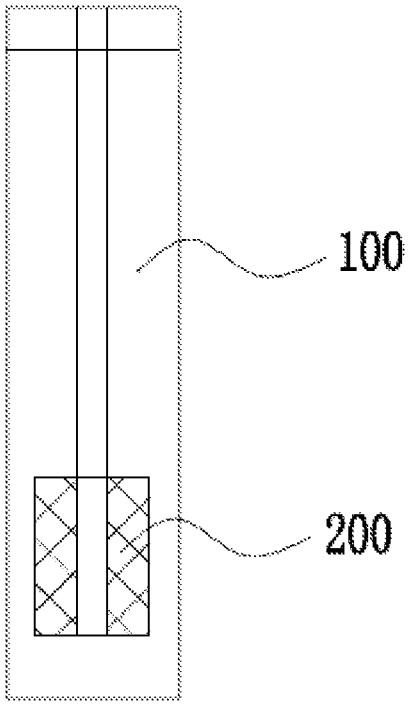
FIG. 6 is a cross-sectional view of an atomizer according to a fifth embodiment, including an atomizing assembly.
Figure 7:
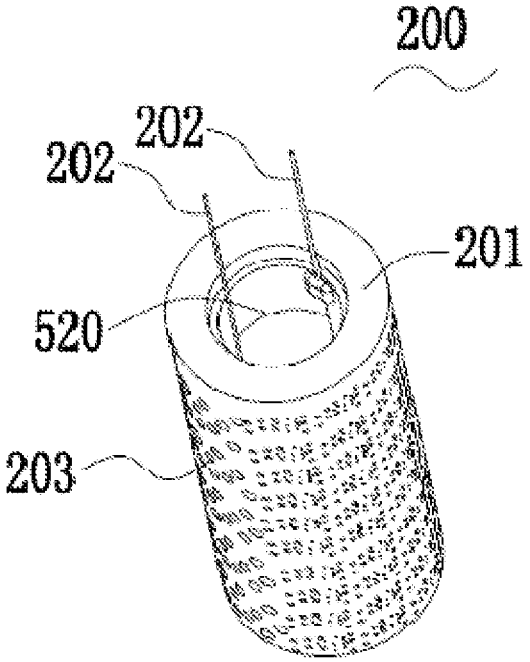
FIG. 7 is a perspective view of the atomizing assembly of FIG. 6.
Figure 8:
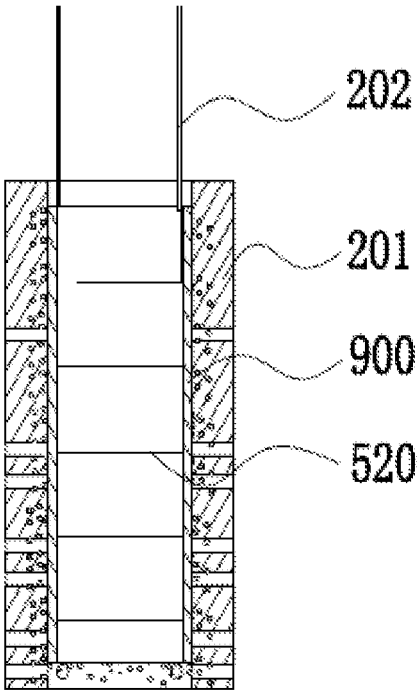
FIG. 8 is a cross-sectional view of an atomizing assembly of FIG. 7.

Referring to FIG. 6, an atomizer according to a fifth embodiment includes an atomizing tube 100 and an atomizing assembly 200 in the atomizing tube 100. Also referring to FIGS. 7-8, the atomizing assembly 200 includes a ceramic tube 201, a heating element 520, and a wire 202. The ceramic tube 201 defines a plurality of liquid absorption holes 203, and is configured for conducting tobacco liquid. The heating element 520 is adhered to an inner wall of the ceramic tube 201 in the form of a printed circuit board. In production, the heating element 520 is printed on a ceramic paper 900, the ceramic paper 900 is wrapped around a base of the ceramic tube 201, and then treated by high temperature calcination.

It is to be noted that the atomizer according to the present embodiment may include a liquid chamber as the first embodiment. It is also to be understood that the atomizer according to the present embodiment may include a liquid storage element without an independent liquid chamber as the second embodiment.

Figure 9:
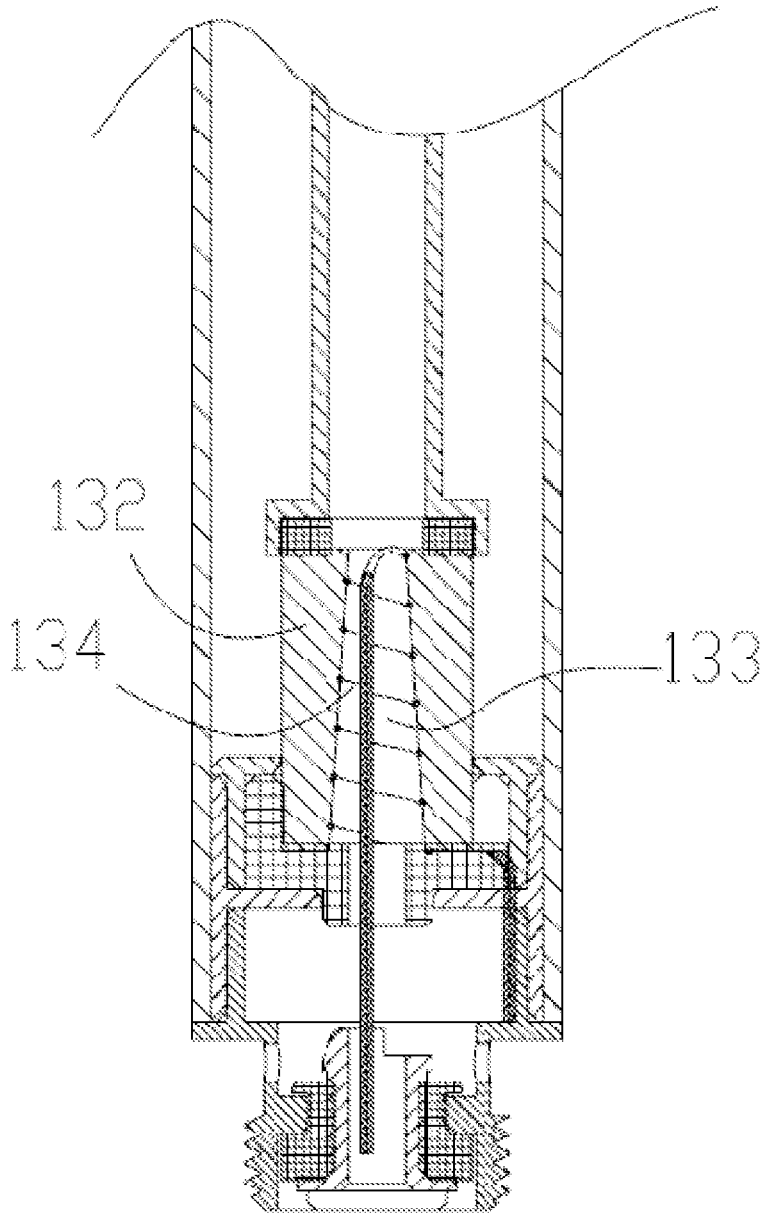
FIG. 9 is a cross-sectional view of an atomizer according to a sixth embodiment.

Referring to FIG. 9, an atomizer according to a sixth embodiment is shown. The atomizer includes a ceramic tube 132, a heating element 134. The ceramic tube 132 defines an air passage 133. The heating element 134 is assembled in an inner wall of the ceramic tube 132 The atomizer is substantially similar to that of the first embodiment, except that the air passage 133 has a shape of truncated cone. The air passage 133 tapers from a bottom part to a top part. The shape of the air passage 133 facilitates assembly and fixing of the heating element 134.

Figure 10:
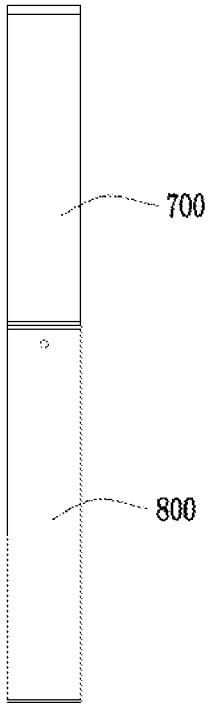
FIG. 10 is a side view of an electronic cigarette according to a seventh embodiment.

Referring to FIG. 10, an electronic cigarette includes an atomizer 700 and a battery assembly 800 electrically connected with the atomizer 700. The atomizer 700 may be any of the atomizers according to the previous embodiments.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer of an electronic cigarette, comprising:

an atomizing tube; and an atomizing assembly arranged in the atomizing tube, the atomizing assembly comprising a ceramic tube, a heating element and wires for being electrically connected between the heating element and a power supply of the atomizer, the heating element extending along a longitudinal direction of the ceramic tube for a preset length and an outer surface thereof being completely in contact with an inner surface of the ceramic tube, the ceramic tube defining a plurality of liquid absorption hole, the wires respectively extending from the heating element toward one end of the ceramic tube along the inner wall of the ceramic tube, and then extending from the one end of the ceramic tube toward the other end of the ceramic tube along an outer wall of the ceramic tube.

2. The atomizer of claim 1, wherein the heating element comprises a heating wire, the heating wire is wound to form a coil, and the coil is received in the ceramic tube to have the entire heating wire being completely in contact with the inner surface of the ceramic tube.

3. The atomizer of claim 1, wherein the heating element and the ceramic tube are integrally formed.

4. The atomizer of claim 1, wherein the ceramic tube is uprightly arranged in the atomizing tube, and the ceramic tube defines an air passage therein.

5. The atomizer of claim 4, wherein the air passage has a shape of truncated cone.

6. The atomizer of claim 1, further comprising an air pipe, wherein the ceramic tube communicates with the air pipe.

7. The atomizer of claim 1, further comprising a liquid storage element wrapping around the ceramic tube and being positioned between the ceramic tube and the atomizing tube.

8. The atomizer of claim 7, further comprising an air pipe disposed next to the atomizing assembly in the atomizing tube, a liquid chamber for accommodating tobacco liquid being defined cooperatively between the air pipe and the atomizing tube.

9. The atomizer of claim 8, wherein at least one liquid outlet is defined at one end of the air pipe engaging with the atomizing assembly, the tobacco liquid accommodated in the liquid chamber flows to the liquid storage element through the at least one liquid outlet.

10. The atomizer of claim 1, further comprising a silicone holder, wherein the wires are connected with two ends of the heating element, and the ceramic tube is engaged with the silicone holder.

11. An electronic cigarette comprising:

an atomizer according to claim 1; and a battery assembly for powering the atomizer.

12. The electronic cigarette of claim 11, wherein the heating element comprises a heating wire, the heating wire is wound to form a coil, and the coil is received in the ceramic tube.

13. The electronic cigarette of claim 11, wherein the heating element and the ceramic tube are integrally formed.

14. The electronic cigarette of claim 11, wherein the ceramic tube is uprightly arranged in the atomizing tube, and the ceramic tube defines an air passage therein.

15. The electronic cigarette of claim 14, wherein the air passage has a shape of truncated cone.

16. The electronic cigarette of claim 11, further comprising an air pipe, wherein the ceramic tube communicates with the air pipe.

17. The electronic cigarette of claim 11, further comprising a liquid storage element wrapping around the ceramic tube.

18. The electronic cigarette of claim 11, further comprising a silicone holder, wherein the wires are connected with two ends of the heating element, and the ceramic tube is engaged with the silicone holder.

19. The atomizer of claim 1, wherein the heating element is adhered to the inner surface of the ceramic tube in the form of a printed circuit board.

* * * * *